US005357871A

United States Patent [19]

Bowman

[11] Patent Number: 5,357,871

[45] Date of Patent: Oct. 25, 1994

[54] LAZY SUSAN SHELF

[75] Inventor: Thomas C. Bowman, Grand Rapids, Mich.

[73] Assignee: Midwest Design, Inc., Grand Rapids, Mich.

[21] Appl. No.: 18,025

[22] Filed: Feb. 16, 1993

Related U.S. Application Data

[63] Continuation of Ser. No. 952,314, Oct. 28, 1992.

[51] Int. Cl.[5] ..... A47B 17/00

[52] U.S. Cl. ..... 108/27; 211/134

[58] Field of Search ..... 108/94, 27, 151; 312/137, 140.4; 211/134

[56] References Cited

U.S. PATENT DOCUMENTS

| | | | |
|---|---|---|---|
| 1,815,304 | 7/1931 | Krag | 108/27 |
| 2,626,845 | 1/1953 | Dubach | 108/27 |
| 3,765,343 | 10/1973 | Ettinger et al. | 108/151 |
| 4,010,698 | 3/1977 | Taub | 108/151 |
| 4,033,461 | 7/1977 | Nevai | 108/27 |

FOREIGN PATENT DOCUMENTS

| | | | |
|---|---|---|---|
| 2637474 | 4/1990 | France | 108/151 |

*Primary Examiner*—Kenneth J. Dorner
*Assistant Examiner*—Gerald D. Anderson
*Attorney, Agent, or Firm*—Warner, Norcross & Judd

[57] ABSTRACT

A molded polymeric lazy susan shelf comprising a horizontal support surface extending radially out from a central, post-receiving hub, a peripheral vertical rim at a outer periphery of the shelf and integral with the support surface, the peripheral rim having a radially inner panel and a radially outer panel spaced from each other and integrally joined by an upper surface, a plurality of vertical, generally cylindrical sleeves between the inner and outer panels at preselected spaced locations of said peripheral rim, each terminating at said upper surface so that said upper surface closes the upper ends of the sleeves, the sleeves having open bottom ends to receive and guide a drill bit inserted to drill an opening at said upper surface of selected ones of said sleeves to receive and provide lateral support for fence posts inserted therein, a plurality of radially extending support ribs beneath and integral with the support surface, and circumferential support rings intermediate the hub and peripheral rim, the rings being vertically oriented, interconnecting with the ribs, and integral with said ribs and the support surface.

4 Claims, 8 Drawing Sheets

LAZY SUSAN SHELF

This is a continuation of application Ser. No. 07/952,314, filed Sep. 28, 1992.

BACKGROUND OF THE INVENTION

This invention relates to a lazy susan shelf assembly and particularly a molded polymeric lazy susan shelf with special fence adaptation and unique strength characteristics.

There are three basic types of lazy susan shelf arrangements used in closed cupboard spaces, namely, the full round type, the kidney type, and the pie-cut, pass-through type. The full round type uses circular shaped shelves which are independent of the cabinet door or doors. The kidney type is also independent of the cabinet door, but is shaped with a recess at a circumferential location to accommodate the doors projecting radially inwardly of the shelf. This recess can cause the shelf to resemble a kidney, hence the name; although in recent years the recess has sometimes resembled a pie-cut. The pie-cut, pass-through type also has a recess, typically shaped like a cut piece of pie, to which is attached the door or doors which form part of the actual cupboard, so that the door passes through the opening in the cupboard when the lazy susan is revolved, hence the name pass-through.

The use of an upstanding fence attached to a lazy susan shelf is well known from prior commercial products. Fences have been used on wood lazy susan shelves for many years, either to separate portions of the shelf and/or to circumferentially encompass the shelf and thereby increase its effective height for retaining products on the shelf. Fences have also been used on polymeric lazy susan shelves in more recent years. These fences are typically clipped onto the shelf, or fence posts are inserted into holes drilled into the wood or plastic, and fence wires connected to the posts. There have been some difficulties in attaching fences in an exact, predetermined location, attaching such easily and yet securely to the shelf units.

Another concern with polymeric lazy susan shelves is that of achieving sufficient strength to accommodate loads a substantial distance from the center post, i.e., to prevent bowing and/or buckling of the shelf. It is common practice to employ radially extending support ribs on the underside of polymeric shelves for strength. However, there is a practical limit in the size and thickness of these ribs.

SUMMARY OF THE INVENTION

An object of this invention is to provide a novel lazy susan shelf structure having simple direct attachment of a fence thereto, the fence being specifically prelocated in its position, readily and easily attached, and stable in its attached condition.

Another object of this invention is to provide a molded, polymeric lazy susan shelf having unique strength to accommodate substantial loads, even those located radially away from the center post.

The novel lazy susan shelf has a plurality of novel, generally cylindrical, vertically oriented sleeves specifically located at predetermined peripheral locations to receive subsequently inserted fence posts securely in exact locations. These sleeves are not initially visible from the top of the shelf, so as not to be unsightly. If no fence is to be employed, the upper peripheral edge of the shelf remains covered so that no distracting fence post holes are visible. If a fence is to be employed, selected sleeves are opened. The sleeves are open on the lower ends thereof to receive and guide a drill bit inserted from the bottom to drill out the closed upper ends of particular sleeves where a fence is to be mounted. Any remaining potential post receiving sleeves are left closed at the upper end for optimum appearance. The fence posts are inserted into the drilled out sleeves which then provide lateral support and stability to the posts.

The polymeric shelf has a plurality of radially extending underside ribs interconnected with at least one novel circumferential ring located intermediate the inner hub and the outer rim of the molded shelf, the vertically extending circumferential ring multiplying the effective strength of the ribs, enabling substantial loads to be placed safely on the polymeric shelf.

These and other objects, advantages and features of the novel lazy susan shelf structure will become apparent upon studying the following specification in conjunction with the drawings.

DESCRIPTION OF THE PREFERRED EMBODIMENTS

Figure 8:
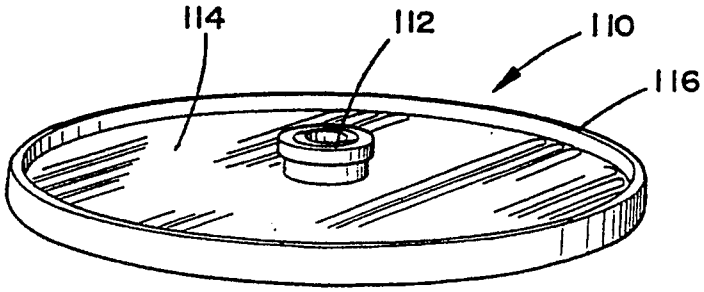
FIG. 8 is a perspective view of the second embodiment of the invention.
Figure 1:
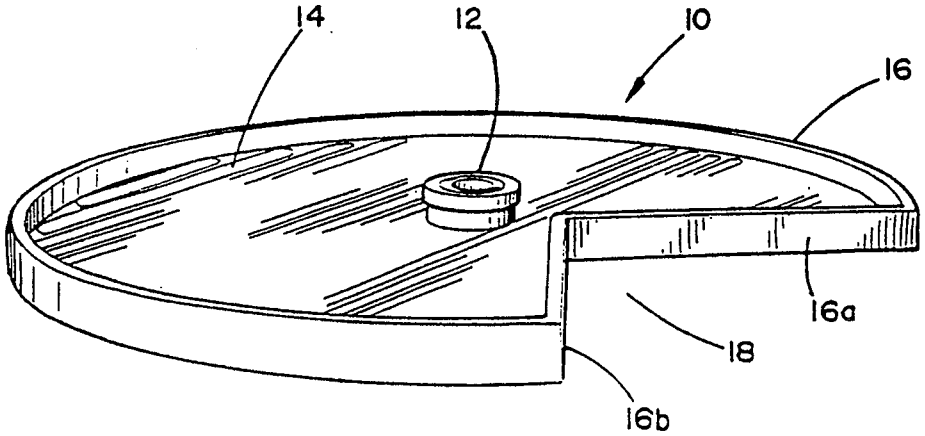
FIG. 1 is a perspective view of one embodiment of a lazy susan shelf according to this invention.
Figure 3:
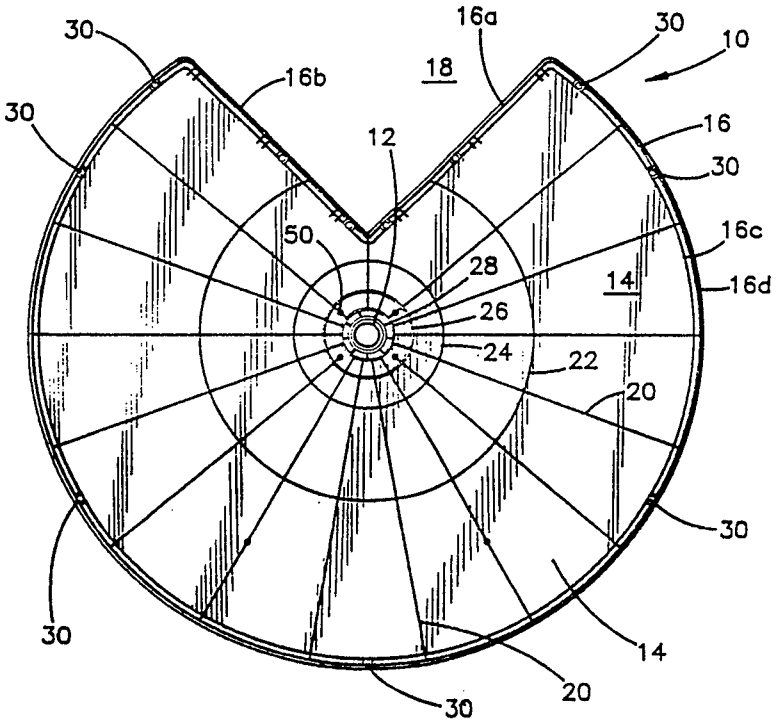
FIG. 3 is a bottom view of the embodiment in FIGS. 1 and 2.
Figure 2:
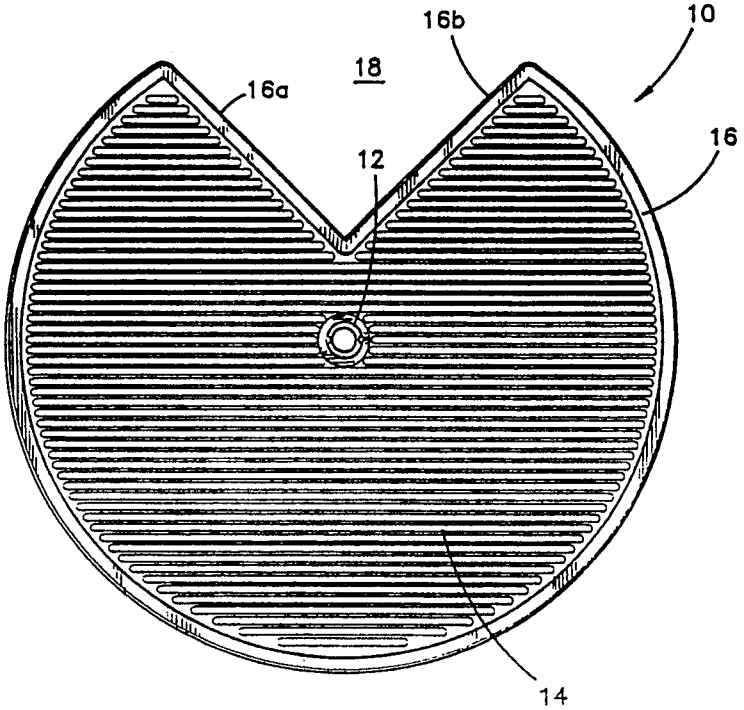
FIG. 2 is a top plan view of the embodiment in FIG. 1.
Figure 7:
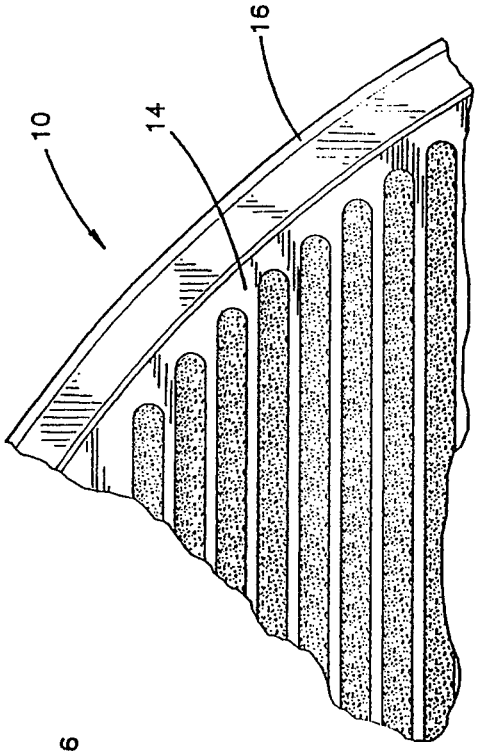
FIG. 7 is an enlarged, fragmentary, plan view of a portion of the shelf in FIG. 2, or the shelf in FIG. 10.
Figure 4:
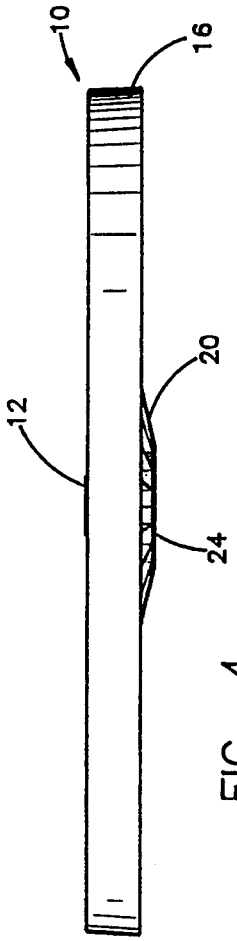
FIG. 4 is an elevational view of the shelf in FIG. 2, viewed from the bottom of FIG. 2.
Figure 5:
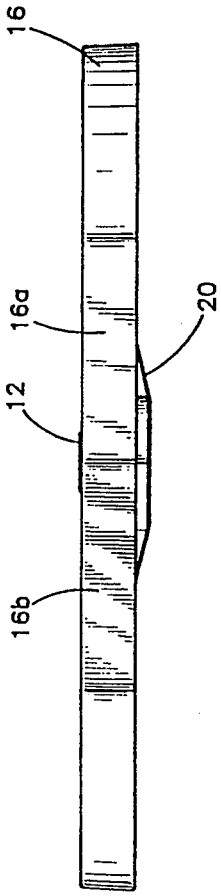
FIG. 5 is an elevational view of the shelf in FIG. 2, viewed from the top of FIG. 2.
Figure 6:
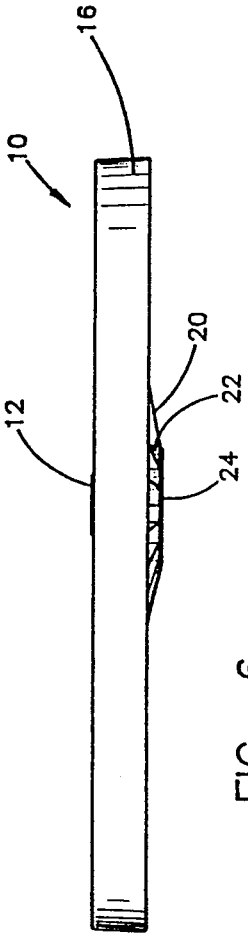
FIG. 6 is a side elevational view of the shelf in FIG. 2, viewed from the right side of FIG. 2.
Figure 10:
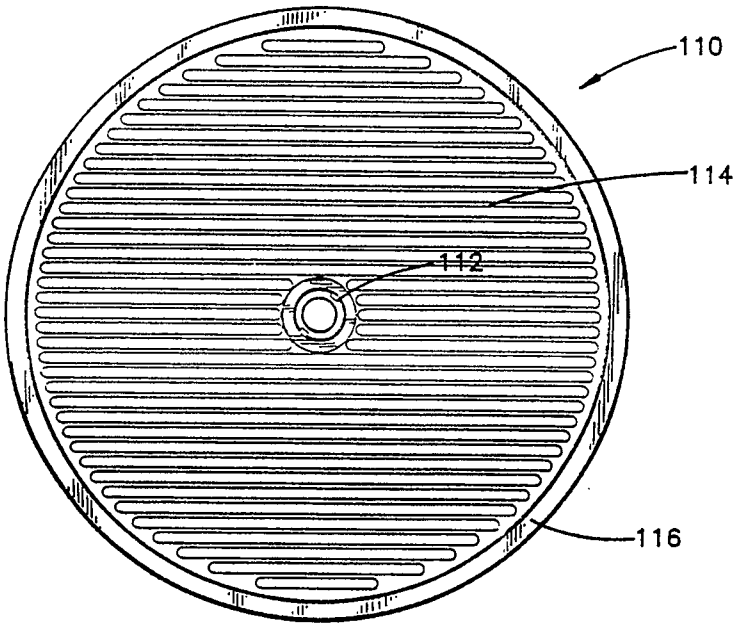
FIG. 10 is a top plan view of the second embodiment.

Referring now specifically to the first embodiment depicted in FIGS. 1–7, the lazy susan shelf 10 there depicted comprises a molded, polymeric member intended for rotational movement about a center post. Thus, the shelf has a central post-receiving hub 12, a horizontal support surface 14 extending radially out from the hub, and a peripheral, vertical rim 16 at the outer periphery of and integral with the support surface and hub. In the embodiment of FIG. 1, a recess 18 is formed in one peripheral portion of the shelf, here shown to be generally pie-shaped. This shelf, therefore, can have a door or doors attached to the radially extending walls 16*a* and 16*b* to form a pie-cut, pass-through lazy susan arrangement, or can be independent of a door or doors so as to form a so-called kidney-type arrangement. Peripheral rim 16 extends above and below the level of horizontal support surface 14 as described in more detail hereinafter.

Figure 12:
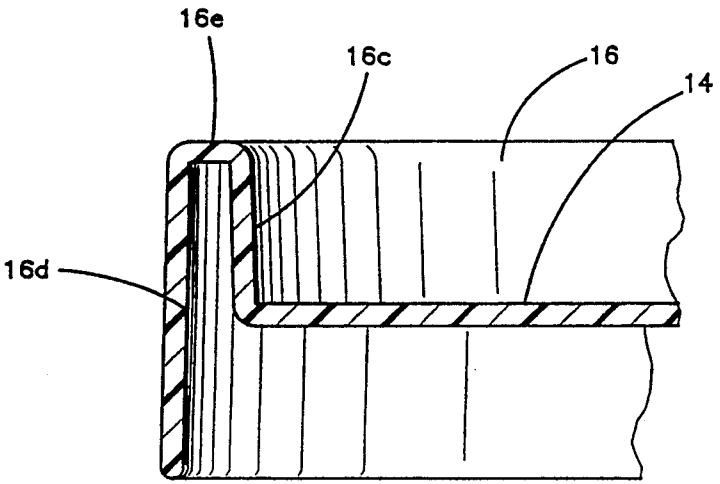
FIG. 12 is an enlarged, fragmentary, sectional view of a portion of the shelf in the first or second embodiments.
Figure 11:
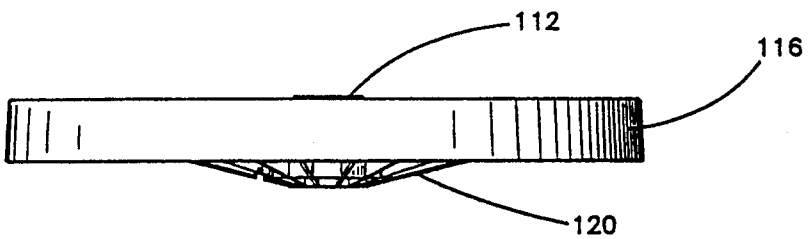
FIG. 11 is a side elevational view of the second embodiment.

Peripheral rim 16 has a radially inner, upright panel 16*c*, a spaced, radially outer, upright panel 16*d*, and a transverse top surface 16*e* (FIG. 12) which integrally joins panels 16*c* and 16*d*. Inner panel 16*c* preferably extends only upwardly from support surface 14, i.e., above the support surface, while outer panel 16*d* is both above and below support surface 14. There is a space between these panels. The peripheral rim 16 includes both panels 16*c* and 16*d* in the areas 16*a* and 16*b* of the recess, as well as around the remaining circumference of the shelf.

A plurality of radially extending ribs 20 (FIG. 3) extend from the central, post-receiving hub 12 out to the outer rim, being integral with the hub, with the support surface 14 and with rim 16. Preferably, the vertical height of these ribs is greatest at the hub and tapers to a lesser height at the rim (FIGS. 4, 5 and 6), in conventional fashion. Intermediate hub 12 and outer rim 16 is at least one circumferential ring which is vertically oriented and integral with the ribs 20 and support surface 14. Specifically, in the embodiment depicted in FIG. 3 there is an outer circumferential ring 22 approximately half way between hub 12 and rim 16, a second circumferential ring 24 closer to the hub, a third circumferential ring 26 closer yet to the hub, and a fourth circumferential ring 28 closely spaced from hub 12. These circumferential rings which are integrally joined with radial ribs 20 and support surface 14 have a multiple strength providing effect to the ribs, to prevent the shelf from bending or buckling under significant load, even if the load is placed radially outwardly a substantial distance from hub 12. Although these rings are all referred to as circumferential, it will be noted that, in the embodiment in FIG. 3, for example, outer ring 22 does not extend the full 360°, due to the recess 18. Between rings 26 and 28 is a plurality of screw-receiving sockets 50 (FIG. 3) for receiving the connecting screws to mount a hub of the type explained hereinafter relative to the second embodiment.)

Figure 13:
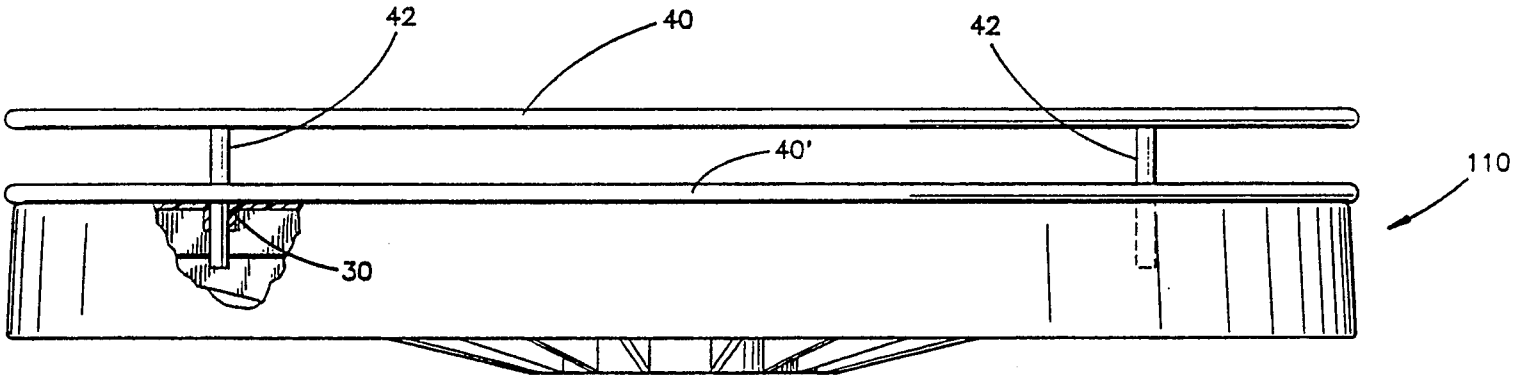
FIG. 13 is an elevational view of the second embodiment showing a fence mounted on the shelf.
Figure 15:
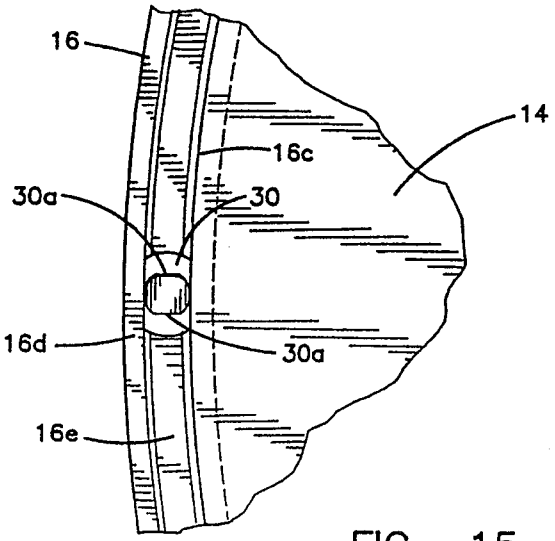
FIG. 15 is a fragmentary, enlarged, bottom view of the structure in FIG. 14.
Figure 14:
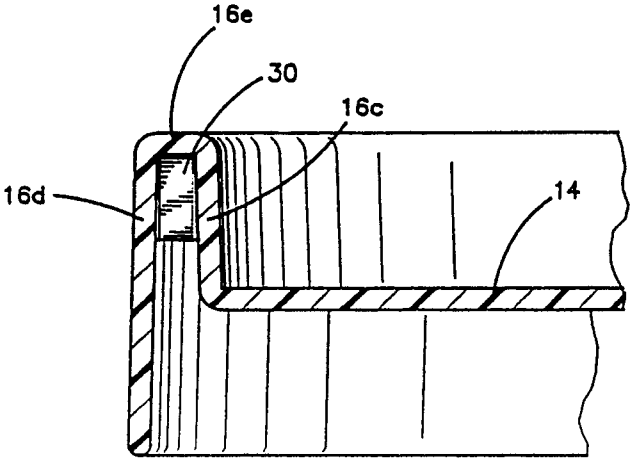
FIG. 14 is a fragmentary, enlarged, sectional view of a portion of the shelf in FIG. 13.

In the space between the inner and outer panels 16*c* and 16*d* of outer rim 16 are located a plurality of vertical, i.e., upright, generally cylindrical sleeves 30 at predetermined locations around the periphery, and optionally also along the walls 16*a* and 16*b* of the recess. These sleeves are molded integrally with panels 16*c* and 16*d* as shown in FIGS. 13, 14 and 15. In the shelf as molded, the upper ends of these sleeves 30 are closed by upper panel 16*e*, as shown in FIG. 14, so as not to be normally visible from above. The elongated, generally cylindrical opening in sleeve 30 preferably has a pair of opposite flats 30*a* (FIG. 15). These sleeves serve effectively to mount the posts of an upstanding fence of the type shown, for example, in FIG. 13.

The fence can be prefabricated of rails 40 (FIG. 13) and 40' integrally connected as by welding to a plurality of posts 42 at specific predetermined locations so that the fence can peripherally enclose and upwardly extend the effective support area for items on the shelf, and/or divide the shelf into segments, as desired. The posts at preselected locations can be inserted into sleeves 30 only by opening the upper ends of the sleeves. This is achieved by inserting a drill bit through the open bottom of the sleeve and cutting out the upper end so that a post can be received. Inasmuch as the sleeve has a slight taper due to the draft angle of the mold form, the upper end of the sleeve can be formed of the same dimension as the vertical post, e.g., one-quarter inch diameter, but the lower portion of the sleeve will have a slightly larger diameter. Thus, the location of the drill bit is assisted by the flats 30*a*, as is the lateral support subsequently provided to the posts 42 when the sleeve receives the posts. Thus, by drilling out only selected ones of the sleeves, and leaving the others untouched so as to be normally invisible, the appearance is optimized with fence posts 42 inserted into those opened sleeves. The sleeves provide support laterally to the posts.

Figure 9:
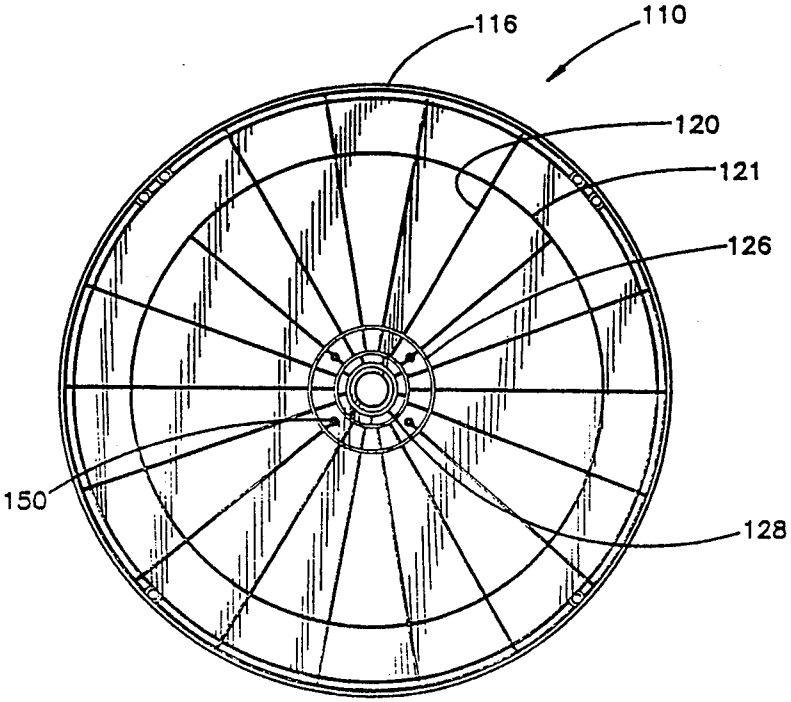
FIG. 9 is a bottom view of the second embodiment.

The second embodiment depicted in FIGS. 8–11 is in the form of a full round shelf 110, having a support surface 114, a central post receiving hub 112, and a peripheral rim 116. This rim has the inner and outer panels as explained heretofore relative to the first embodiment, as well as radial ribs 120, and includes at least one circumferential ring 121 (FIG. 9). It is here shown to include three such circumferential rings 121, 126 and 128. These peripheral rings are all integral with the ribs 120 and support surface 114.

Figure 16:
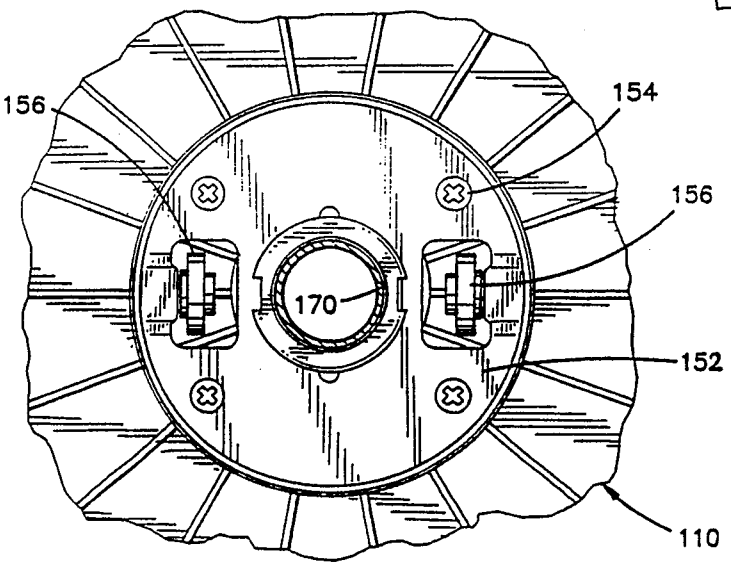
FIG. 16 is a fragmentary, enlarged view of a center portion of the shelf in the second embodiment, showing a rotary hub mounted thereon.
Figure 17:
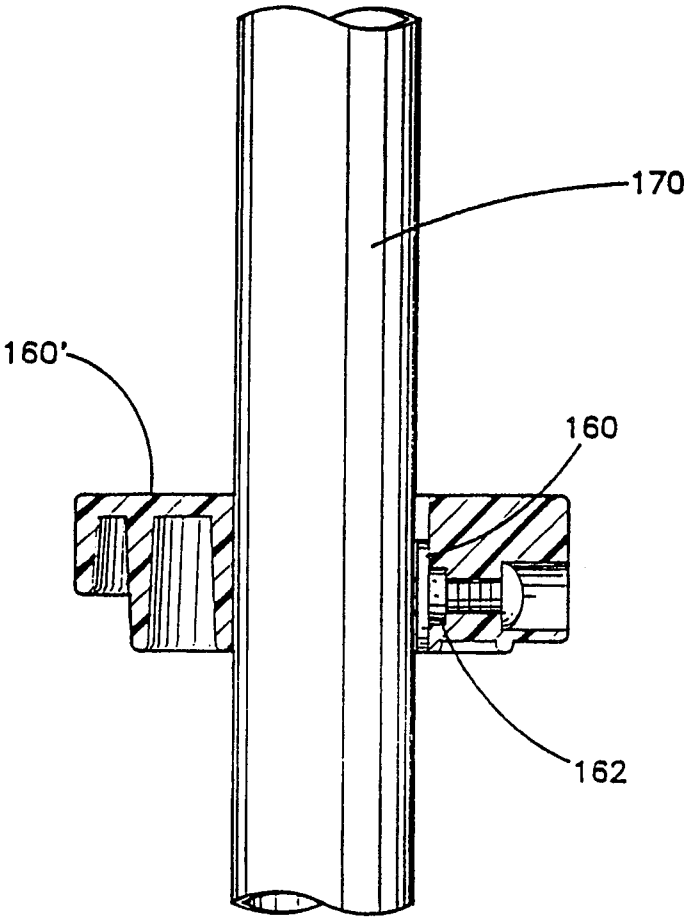
FIG. 17 a fragmentary, enlarged, elevational view of a mounting post and support platform for interengagement with the hub and shelf in FIG. 16.

Between rings 126 and 128 are shown a plurality, here four, of screw-receiving cavities 150 for mounting a hub 152 by a plurality of screws 154 (FIG. 16). This hub preferably has a plurality, here shown to be two, of rollers 156 mounted on opposite sides of the hub, to enable the shelf 110 to rotate on a fixed support platform 160 (FIG. 17) affixed to the support post 170. Support platform 160 includes an upper surface 160' to be engaged by rollers 156, and has a pair of set screw locks 162 for securing platform 160 to post 170 at a selected height.

Figure 18:
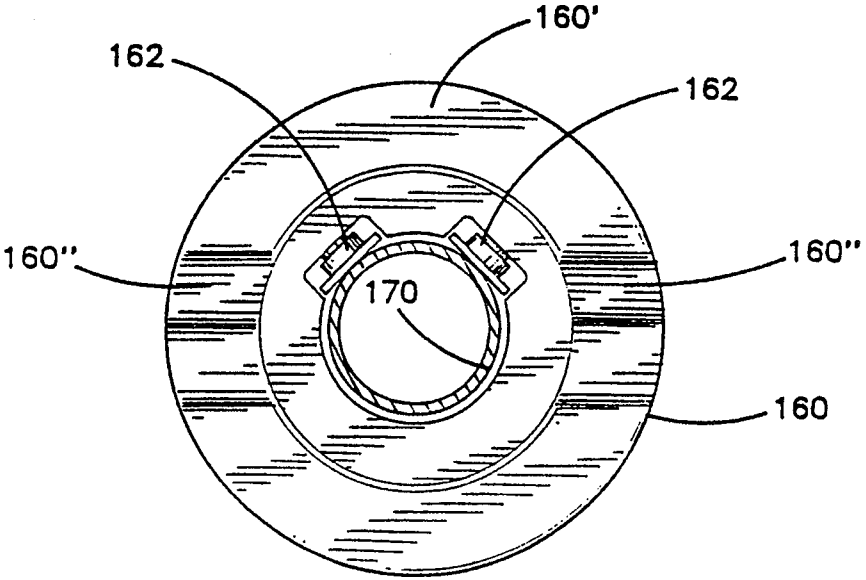
FIG. 18 is a sectional plan view of the platform and post in FIG. 17.
Figure 20:
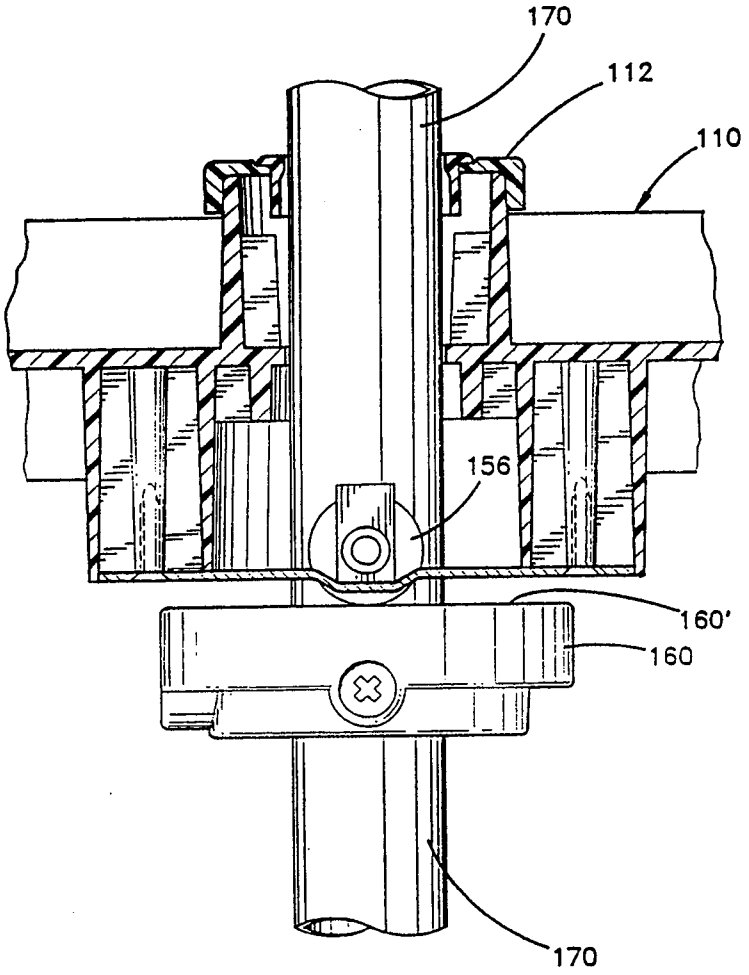
FIG. 20 is a fragmentary, enlarged, sectional, elevational view of the apparatus in FIG. 19, not in the home position.
Figure 19:
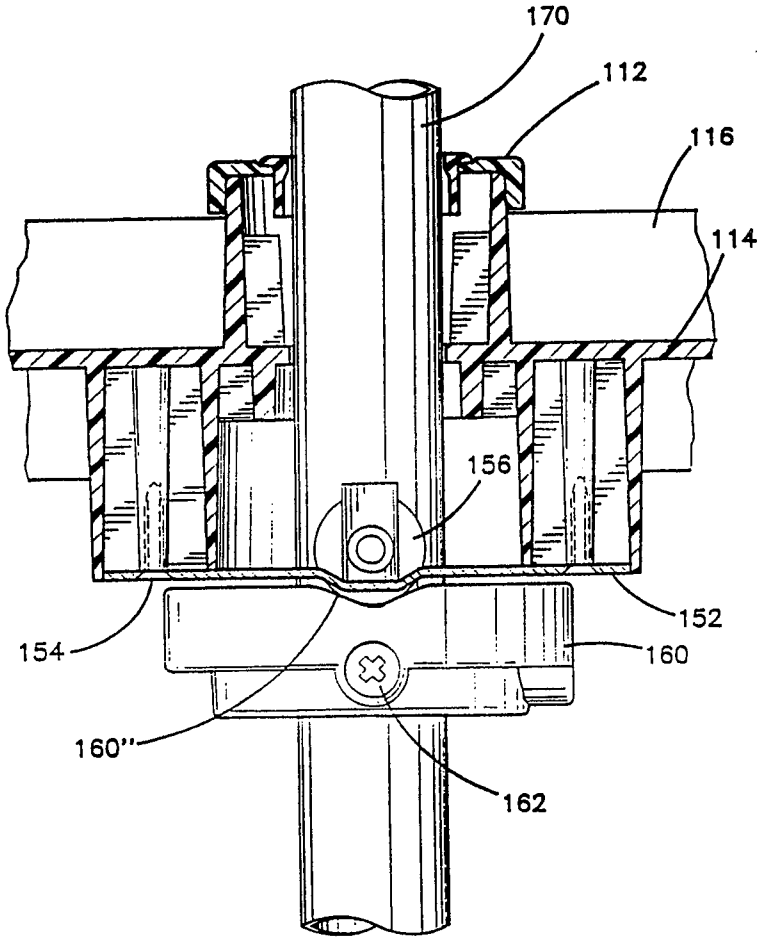
FIG. 19 is an enlarged, elevational, sectional view of an assembly of the shelf, hub and platform and post in the home position.

The upper surface 160' of hub 160 also preferably includes a pair of indentations or recesses 160'' on opposite sides (FIGS. 18 and 19) to simultaneously receive rollers 156 for locating the rotational shelf in a "home" position. This is particularly advantageous with a kidney-type shelf so that recess 18 is located where the cupboard door (not shown) can close, or on a pie-cut version where the doors are mounted on segments 16*a* and 16*b*, so that the doors will align with the remainder of the cupboard. Thus, rollers 156 and the shelf can be at one vertical elevation on surface 160' (FIG. 20) through most of the 360° rotation, but can momentarily be at a slightly lower elevation in recess 160'' in the home position.

In use of the invention, the particular type of shelf, e.g., full round or kidney, can be selected for the particular installation, the hub 152 mounted on the bottom thereof with screws 154, platform 160 affixed to post 170, the particular sleeves 30 to which a fence, if any, is to be attached drilled out from the underside to open the tops of the sleeves, fence posts 42 inserted into drilled out sleeves 30, and main support post 170 upper and lower ends affixed within the cabinet. The lazy susan is then ready for use.

Certain additional features, objects and advantages will likely occur to those in the art upon studying the foregoing disclosure. It is intended that the invention be limited only by the scope of the appended claims and the reasonably equivalent structures to those set forth therein.

The embodiments of the invention in which an exclusive property or privilege is claimed are defined as follows:

1. A molded polymeric lazy susan shelf comprising:
a central post-receiving hub;
a horizontal support surface extending radially out from said hub;
a peripheral vertical rim at the outer periphery of and integral with said support surface;
said peripheral rim having a radially inner panel and a radially outer panel spaced from each other and integrally joined by an upper surface, thereby defining a space therebetween;
a plurality of vertical, generally cylindrical sleeves in said space between said inner and outer panels at preselected spaced locations of said peripheral rim, each terminating at said upper surface so that said upper surface closes the upper ends of said sleeves;
said sleeves having open bottom ends to receive and guide a drill bit inserted to drill an opening at said upper surface of selected ones of said sleeves; and
said sleeves having an inner surface and being integral with said inner and outer panels to provide lateral support for fence posts inserted therein.

2. The lazy susan shelf in claim 1 including a fence mounted thereon, said fence having a plurality of vertical posts inserted down into selected ones of said sleeves and into engagement with said inner surface of said selected ones, and having at least one rail between said posts.

3. A molded polymeric lazy susan shelf comprising:
a central post-receiving hub;
a horizontal support surface extending radially out from said hub;
a peripheral vertical rim at the outer periphery of and integral with said support surface;
said peripheral rim having at least one vertical panel and an integral upper surface;
a plurality of vertical, generally cylindrical sleeves at preselected spaced locations of said peripheral rim, each terminating at said upper surface so that said upper surface closes the upper ends of said sleeves;
said sleeves having open bottom ends to receive and guide a drill bit inserted to drill an opening at said upper surface of selected ones of said sleeves; and
said sleeves being integral with said panel to provide lateral support for fence posts inserted therein.

4. A molded polymeric lazy susan shelf assembly comprising:
a central post-receiving hub;
a horizontal support surface extending radially out from said hub;
a peripheral vertical rim at the outer periphery of and integral with said support surface;
said peripheral rim having a radially inner panel and a radially outer panel spaced from each other and integrally joined by an upper surface, thereby defining a space therebetween;
a plurality of vertical, generally cylindrical sleeves in said space between said inner and outer panels at preselected spaced locations of said peripheral rim;
said sleeves being integral with said inner and outer panels to provide lateral support for fence posts inserted therein; and
a fence mounted on said shelf, said fence having a plurality of vertical posts inserted down into selected ones of said sleeves, and having at least one rail between said posts.

* * * * *